United States Patent [19]

Neathery et al.

[11] Patent Number: 4,919,564

[45] Date of Patent: Apr. 24, 1990

[54] MANHOLE INSERT

[75] Inventors: David L. Neathery, Shreveport; Harold E. Owen, II, Keithville, both of La.

[73] Assignee: David L. Neathery, Shreveport, La.

[21] Appl. No.: 284,620

[22] Filed: Dec. 15, 1988

[51] Int. Cl.[5] ..... E02D 29/14

[52] U.S. Cl. ..... 404/25; 277/207 R

[58] Field of Search ..... 404/25; 52/19, 20; 137/371; 277/166, 183, 184, 207 R, 218 C; 248/903; 220/378

[56] References Cited

U.S. PATENT DOCUMENTS

| | | | |
|---|---|---|---|
| 606,554 | 6/1898 | Jacobs | 404/25 X |
| 3,969,847 | 7/1976 | Campagna et al. | 52/1 |
| 3,973,856 | 8/1976 | Gaglioti | 404/25 |
| 4,067,659 | 1/1978 | Campagna, Jr. et al. | 404/25 |
| 4,392,657 | 7/1983 | Roley | 277/166 X |
| 4,650,365 | 3/1987 | Runnels | 404/25 |
| 4,721,314 | 1/1988 | Kanayama et al. | 277/166 X |
| 4,758,004 | 7/1988 | Semon | 277/207 R |

FOREIGN PATENT DOCUMENTS

| | | | |
|---|---|---|---|
| 1217 | of 1914 | United Kingdom | 404/25 |

*Primary Examiner*—William P. Neuder

*Attorney, Agent, or Firm*—John M. Harrison

[57] ABSTRACT

A watertight manhole insert which is characterized by a dish-shaped seal or stopper designed to prevent rainwater from entering a sanitary sewer system through a manhole closed by a manhole cover. The manhole insert is located beneath the manhole cover and serves to plug the manhole and prevent flooding of the underlying sewer system. The manhole insert is characterized by a dish-shaped bowl having a pressure-relief valve, an optional vacuum relief valve and left strap and a substantially perpendicular, upward-standing side wall fitted with an outwardly-extending top rim for engaging a shoulder shaped in a manhole to support the manhole insert. Multiple, upward-standing bottom ribs radiate from the side wall inwardly in the curved bowl bottom toward the pressure relief valve, which is normally located in the center of the manhole insert, in order to stiffen the bowl-shaped bottom. Optional side ribs may also be provided in the vertical side wall for stiffening purposes. In a preferred embodiment the rim is sandwiched between two parallel elements of a ribbed rubber seal which is locked into the rim, the top of which seal receives the manhole cover and the bottom of which includes spaced seal ribs which engage the manhole shoulder and act as water barriers.

41 Claims, 1 Drawing Sheet

MANHOLE INSERT

BACKGROUND OF THE INVENTION

1. Field of the Invention

This invention relates to manholes for sewer systems and more particularly, to a watertight manhole insert which is designed to seal the manhole immediately beneath a manhole cover to prevent flooding of the sewer system. In a preferred embodiment of the invention the manhole insert is characterized by a bowl-shaped dish having a rounded or cupped bottom provided with a pressure relief valve and an optional vacuum relief valve, and having vertical sides which are terminated by an outwardly-projecting rim adapted for seating on a shoulder formed in the manhole beneath the manhole cover. In a most preferred embodiment of the invention the outwardly-extending rim is sandwiched between a ribbed seal, the upper flat element of which seal receives the manhole cover and the ribbed bottom element resting on the shoulder shaped in the manhole, to prevent, or at least minimize, the flow of water from ground level around the manhole cover and through the manhole, into the sewer system. The rounded, dish-shaped bottom of the manhole insert is provided with spaced ribs for strength and both ends of a lift strap may be attached to the insert bottom, in order to facilitate lifting and removing the manhole insert from a mounted position in the manhole. In another preferred embodiment of the invention one or more side ribs or stiffeners may be provided in the upward-standing side wall extending from the dish of the manhole insert, to provide additional side wall strength. The pressure relief valve is designed to relieve pressure which may be generated in the sewerage system served by the manhole, while the optional vacuum relief valve operates to relieve any vacuum which may develop in the sewerage system.

One of the problems which is associated with sewerage systems is that of flooding during periods of high water due to prolonged or heavy rainfall. This problem is intensified in both urban and surburban areas where increased construction activity has resulted in large quantities of concrete being poured to construct parking lots, as well as foundations and other structures. This increase in non-permeable construction material reduces the amount of surface area which is available to absorb rainfall and increases the flow of water in storm drains and sewerage systems, as well as diversion canals, natural streams and other channels which must accept and dispose of the increased flow of water. These conditions of urban and suburban development result in flooding, under circumstances where the water exceeds the capacity of storm drain and sewerage systems, which systems are sized to receive a specified average flow of water. Moreover, it is customary to provide separate drainage systems for rainwater and sewage and flooding of the sewerage systems by rainwater runoff sometimes creates a contamination problem.

2. Description of the Prior Art

Various types of closures and covers, many of which are fitted with ventilating means, have been long known in the art. An early patent which details such a closure is the "Ventilating Vault Cover" detailed in U.S. Pat. No. 606,554, dated Jun. 28, 1898, to J. Jacobs. The ventilating vault cover is designed to close a vault opening in a watertight manner when in a closed position and vent the vault when in open configuration. U.S. Pat. No. 3,046,853, dated July 31, 1962, to C. Legendre, discloses a "Manhole Closure". The manhole closure includes a lid of one-piece construction which cooperates with a seat or manhole frame, also of one-piece construction, such that the two parts can be easily assembled for mounting in a manhole. A "Safety Replacement Cover for Catch Basins" is detailed in U.S. Pat. No. 2,576,353, dated Nov. 27, 1951, to O. W. Nelson. The cover detailed in this patent includes a dish-like, reticulate tray which is designed to provide adequate drainage into a catch basin and facilitates safety to prevent injury from stepping into the catch basin. A "Manhole Cover" is covered in U.S. Pat. No. 3,920,347, dated Nov. 18, 1975, to John T. Sauriol, et al. The manhole cover is constructed of a molded synthetic polymeric material and has a transversely intersecting structural rib network which is integrally joined with a top surface portion and encloses annular peripheral portions of the cover. The structural rib network is preferably dome-shaped, with the principal structural support disposed centrally of the cover at the apex of the dome. A "Drain Hole Seal With Bottom Bleeder" is detailed in U.S. Pat. No. 4,649,674, dated Mar. 17, 1987, to Craig S. Gaul, et al. The patent details a seal structure having a bottom bleeding feature such as a bottom bore and fitted with a flange to facilitate sealing engagement between a cover and a frame located around an access opening of the manhole. The structure includes a central portion which is downwardly depressed to avoid a path of spin of the cover. A "Watertight Manhole Insert" is set forth in U.S. Pat. No. 4,650,365, dated Mar. 17, 1987, to Franklin D. Runnels. The manhole insert is designed to prevent rainwater from entering a sanitary sewer system through manholes which are closed by manhole covers. The insert includes a shallow, dish-shaped body portion and a mounting flange designed to rest upon the supporting flange of a manhole frame. A recess is formed in the bottom of the body portion and includes a valve for releasing pressure which accumulates in the manhole beneath the insert. The valve is shielded to prevent damage by a manhole cover sliding across the insert. Additionally, the valve can be used as a handle to remove the insert from the manhole. The Runnels insert has also been modified in application to include a circumferential rib near the rim for stiffening purposes. A "Manhole Closure Assembly" is detailed in U.S. Pat. No. 4,067,659, dated Jan. 10, 1978, to Samuel A. Campagna, Jr., et al. The assembly is designed to prevent accumulated storm water from entering into a manhole opening and includes a cover section having a downwardly-depressed central portion. A circular mounting flange extends outwardly from the depressed central portion and the flange is adapted to rest upon inwardly-directed manhole cover supporting flanges of the annular manhole frame. The cover section is depressed, such that the cover exceeds the path of spin when resting upon the supporting flange of the manhole frame. A valve is secured to the cover section for the purpose of relieving pressure inside the manhole when the sewer pressure exceeds a predetermined level.

It is an object of this invention to provide a new and improved manhole insert which is designed to close and substantially seal a manhole to prevent rainwater from flooding a sewerage system communicating with the manhole.

Another object of the invention is to provide a manhole insert which is molded, stamped or otherwise shaped from a selected metal or synthetic polymeric material into a dish-shaped, flanged bowl having upward-standing ribs in the dish section thereof for installation on a shoulder provided in a manhole beneath the manhole cover, in order to prevent, or at least reduce, the flow of rainwater into the manhole and the underlying disposal system.

A still further object of this invention is to provide a manhole insert having a dish-shaped bottom fitted with an upward-standing, substantially vertically-oriented side having at least one circumferential side rib for stiffening purposes and a flange or rim outwardly-extending from the side, which rim engages the shoulder of a manhole located beneath the manhole cover to retard water from flowing into the manhole and the underlying sewer or drainage system.

Yet another object of the invention is to provide a manhole insert for retarding the flow of water into a sewerage system through a manhole, which insert is characterized by a dish-shaped closure having an outwardly-projecting flange or rim that is fitted with a locked-on rubber seal and further including upward-standing ribs spaced in the dish portion thereof, which manhole insert is located in the manhole beneath the manhole cover.

Still another object of this invention is to provide a new and improved manhole insert which includes a dish-shaped stopper or plug having a pressure relief valve and a vacuum relief valve mounted therein and further including an outwardly-extending rim fitted with a locked-on rubber seal, multiple upward-standing, spaced ribs provided in the bowl-shaped bottom of the insert and an optional lift strap attached to the bowl portion of the insert at both ends, for removing the insert from a manhole located beneath the manhole cover.

Another object of the invention is to provide a new and improved, ribbed manhole insert which is fitted with a locked-on rubber seal for mounting in the upper portion of a manhole beneath the manhole cover, which rubber seal includes a top element and a bottom element sandwiched on the manhole insert rim, wherein the top element is permanently attached to the bottom element at spaced intervals through holes or openings provided in the rim, in order to reduce or prevent the flow of water into an underlying sewerage system, control manhole odor and prevent the accumulation of dirt and trash in the manhole and the underlying sewer.

SUMMARY OF THE INVENTION

These and other objects of the invention are provided in a manhole insert for sewerage systems, which insert is characterized by a molded, stamped, pressed or otherwise formed dish-shaped bowl provided with pressure and vacuum relief valves and an upward-standing, substantially vertically-oriented side having optional circumferential side ribs and an outwardly projecting rim for seating in a manhole beneath the manhole cover, in order to prevent rainwater from flowing around the edge of the manhole cover into the manhole and through the underlying sewage system. In a preferred embodiment, at least one rib is provided in the rounded dish or bowl for stiffening and strengthening purposes and a locked-on rubber seal is secured to the rim by glue or ultrasonic weld and is provided with downwardly-extending ribs for engaging a manhole ledge or shoulder built into the manhole. A lift strap may also be riveted or connected at both ends to the rounded dish, in order to facilitate easy removal of the insert from the manhole.

BRIEF DESCRIPTION OF THE DRAWING

The invention will be better understood by reference to the accompanying drawing, FIG. 1 a perspective view of the manhole insert of this invention mounted in functional configuration in a manhole.

DESCRIPTION OF THE PREFERRED EMBODIMENTS

Figure 1:
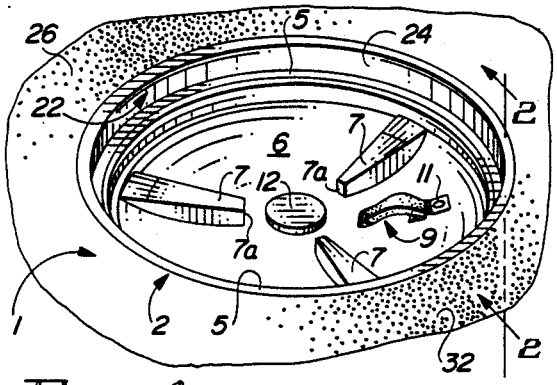
Figure 2:
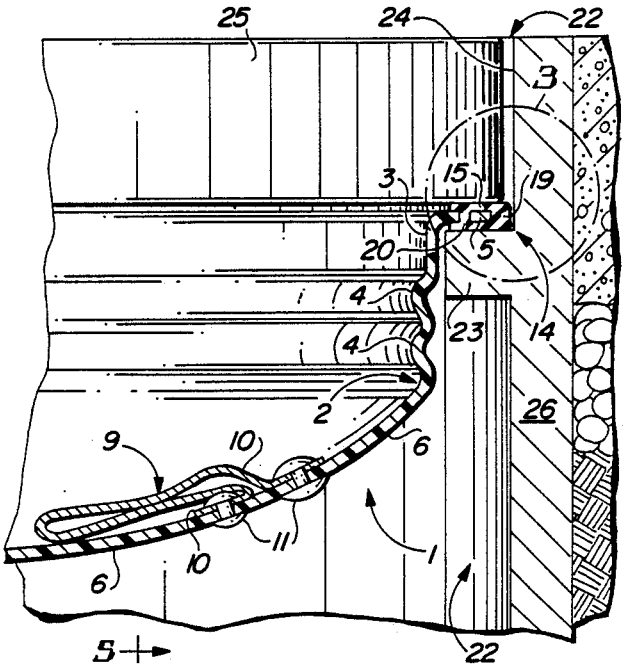
FIG. 2 is a sectional view taken along line 2—2 of the manhole insert illustrated in FIG. 1, more particularly illustrating optional side wall ribs provided in the side wall of the manhole insert dish.
Figure 3:
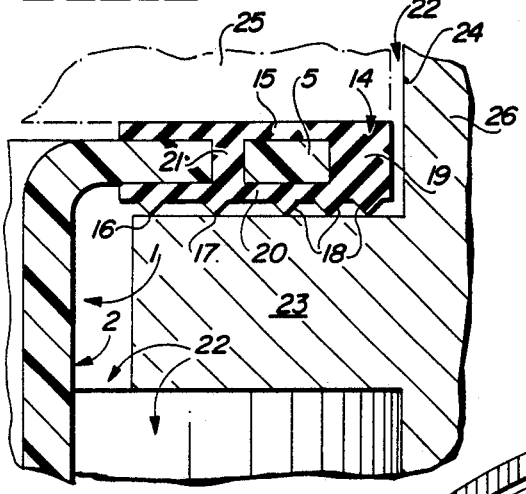
FIG. 3 is an enlarged sectional view of a preferred locked-on ribbed seal mounted on the rim of the manhole insert illustrated in FIGS. 1 and 2.

Referring initially to FIGS. 1–3 of the drawing, the manhole insert of this invention is generally illustrated by reference numeral 1. The manhole insert 1 is characterized by a dish 2, having a curved bottom 6 which terminates in a circular, upward-standing side 3. A rim 5 projects outwardly from the top edge of the side 3 in substantially perpendicular relationship and seats in the manhole 22 beneath the street level 32, as hereinafter described. Three bottom ribs 7 are disposed in spaced relationship in the curved bottom 6, as illustrated in FIG. 1. In a most preferred embodiment the dish 2 is molded from a suitable moldable plastic material, as hereinafter described, and the bottom ribs 7 are vacuum molded or otherwise configured in the curved bottom 6, as illustrated. Alternatively, the dish 2 can be stamped, pressed, cast or otherwise formed from a suitable metal such as aluminum and stainless steel, in non-exclusive particular. A pressure relief valve 12 is seated substantially in the center of the curved bottom 6 as further illustrated in FIG. 1, in order to release pressure which may build up in the manhole 22. In another preferred embodiment of the invention the manhole insert 1 is mounted in the manhole 22 with the rim 5 engaging a manhole shoulder 23, located in the manhole structure 26, as illustrated in FIG. 2. In a most preferred embodiment of the invention a ribbed rubber seal 14 is fitted on the rim 5, with a flat top segment 15 receiving the conventional manhole cover 25 and the bottom segment 20 lying adjacent to and resting on the manhole shoulder 23 of the manhole structure 26, as further illustrated in FIGS. 2 and 3. The top segment 15 and the bottom segment 20 are typically formed integrally with an end segment 19, which extends around the edge of the rim 5. In still another preferred embodiment of the invention, the bottom segment 20 of the ribbed seal 14 is provided with spaced outer ribs 18 which are located near the outer periphery of the manhole shoulder 23, an inner rib 16 which is positioned inwardly of the outer periphery of the manhole shoulder 23 and a middle rib 17, which is spaced between the inner rib 16 and the outer ribs 18, as illustrated in FIG. 3. The spacial orientation of the outer ribs 18 is most preferably in close proximity to each other, wherein three such outer ribs 18 are provided, whereas the inner rib 16 and the middle rib 17 are preferably spaced farther apart and farther from the outer ribs 18, as illustrated in FIG. 3. The inner ribs 16, middle ribs 17 and outer ribs 18 serve to prevent, or at least minimize, the flow of water around the manhole cover 25 and across the manhole shoulder 23 into the manhole 22, as further illustrated in FIG. 3. In a most preferred embodiment of the invention, the top segment 15 is ultrasonically welded, glued, or otherwise attached to the top surface of the rim 5. Alternatively, the top segment 15 can be ultrasonically welded or glued to the bottom segment 20 through spaced openings (not illustrated) provided in the rim 5, to define a plug 21, as illustrated in FIG. 3, in order to better secure the ribbed seal 14 to the rim 5. Still further in the alternative, a separate plug 21 can be inserted in the spaced openings between the top segment 15 and the bottom segment 20 and the plug 21 can be glued, ultrasonically welded or otherwise secured in place.

Figure 4:
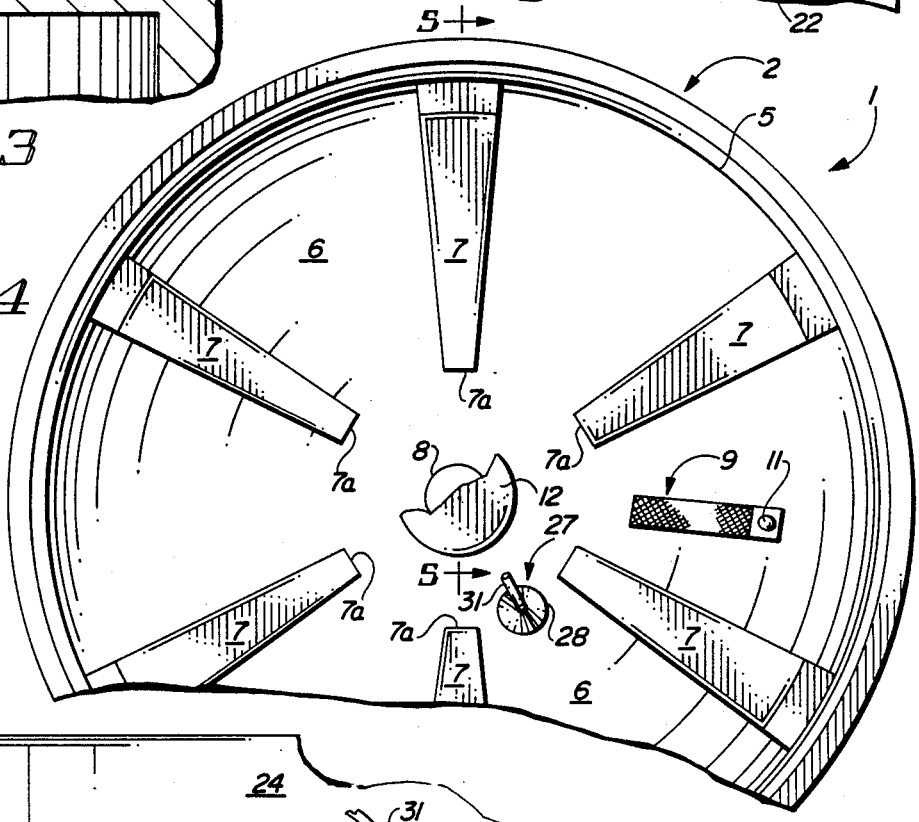
FIG. 4 is a top view, partially in section, of an alternative preferred manhole insert which includes six upward-standing ribs located in the curved bottom of the insert dish.
Figure 5:
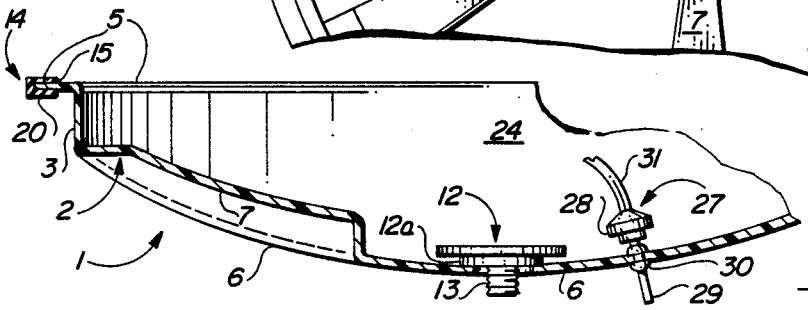
FIG. 5 is a sectional view taken along line 5—5 of the manhole insert illustrated in FIG. 4.

Referring now to FIGS. 4 and 5 of the drawing, in an alternative preferred embodiment of the invention the manhole insert 1 is characterized by six spaced bottom ribs 7, in order to further stiffen the curved bottom 6. As in the case of the manhole insert 1 illustrated in FIGS. 1–3, the manhole insert 1 illustrated in FIG. 4 is designed such that the rib ends **7*a* terminate in spaced relationship with respect to the valve 12, which is threadably inserted by means of a companion threaded nipple 13, in a bottom opening 8 located in the curved bottom 6 of the dish 2, as further illustrated in FIG. 5. The valve shoulder 12*a* serves the dual function of stabilizing the pressure relief valve 12 against shock and facilitating sealing of the pressure relief valve 12 to allow a selected water flow rate therethrough. In both of the embodiments of the manhole insert 1 illustrated in FIGS. 1 and 4, the bottom ribs 7 are preferably shaped from the curved bottom 6 by application of stamping, pressing, casting or vacuum molding techniques which are well known to those skilled in the art. Accordingly, it will be appreciated that the manhole insert 1 can be configured from molded synthetic polymeric materials such as polyethylene, polypropylene and acrylonitrile-butadiene-styrene, commonly called ABS, as well as metals such as aluminum and stainless steel, in non-exclusive particular. Furthermore, in a most preferred embodiment of the invention, the locked on ribbed seal 14 is of the envelope style and is constructed of EPDM rubber which is welded, glued or otherwise secured or "locked" to the rim 5 by a suitable rubber cement, as heretofore described. In still another most preferred embodiment of the invention, the valve 12 is designed to relieve at a pressure of one-half p.s.i. and to have a water leak-down rate not exceeding five gallons for 24 hours. Furthermore, the valve 12 is preferably fitted with a threaded nipple 13, as illustrated in FIG. 5, which threaded nipple 13 is threadably seated in the bottom opening 8 provided in the curved bottom 6, as illustrated in FIG. 4 of the drawing. Moreover, as illustrated in FIG. 5, an optional vacuum relief valve 27 can be installed in an opening (not illustrated) provided in the curved bottom 6. A grommet 30 seats the mount stem 29 in this opening and a valve body 28 is attached to the hollow mount stem 29. An extension tube 31 is also secured to the upper end of the mount stem 29, in order to project above any trash, dirt or ice which may accumulate in the curved dish 2 and maintain effective function of the vacuum relief valve 27**.

Referring now to FIG. 2 of the drawing, in yet another preferred embodiment of the invention a pair of circumferential side ribs 4 are provided in the upward-standing side 3, in order to further stiffen the side 3 and strengthen the dish 2. It will be appreciated by those skilled in the art that one or more side ribs 4 can be provided, as desired, although a pair of side ribs 4 is most preferred, in order to facilitate a desired stiffening of the side 3.

In another preferred embodiment of the invention and referring again to FIGS. 1, 2 and 4 of the drawing, a lift strap 9 is secured at the strap ends 10 to the curved bottom 6 in spaced relationship, by means of stainless steel rivets 11. Since it is common practice for workmen to engage the lift strap 9 with a pick or other tool, in order to remove the manhole insert 1 from the manhole 22, it has been found that the lift strap 9 must be secured at both of the strap ends 10 to the curved bottom 6 of the dish 2 to insure that the lift strap 9 does not tear away from the curved bottom 6. It has been found that when the lift strap 9 is attached to the dish 2 by the two stainless steel rivets 11 in this manner, a force in excess of 500 pounds is necessary to tear the strap away from the dish 2.

It will be appreciated by those skilled in the art that the manhole insert of this invention is characterized by convenience and flexibility and operates to stop the flow of rainwater into sewage systems, control manhole odors, prevent dirt and trash accumulating in the manhole and the sewerage system and helps to prevent manhole rattling and "flipping" due to street traffic. The manhole insert 1 can be constructed of extremely durable polyethylene, polypropylene or ABS plastic, as well as a metal such as aluminum or stainless steel, and is configured to be maintained in position on the manhole shoulder in a manhole without dropping from that position into the manhole or sewer underlying the manhole.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A manhole insert for location in a manhole beneath a manhole cover, said manhole insert comprising a dish-shaped body having a curved bottom terminated by an upward-standing side wall; at least one bottom rib provided in said bottom for strengthening said bottom; a pressure relief valve provided in said bottom for releasing pressure in the manhole; and a rim shaped in the top edge of said side wall for supporting said manhole insert in the manhole.

2. The manhole insert of claim 1 wherein said at least one bottom rib further comprises a plurality of bottom ribs provided in said bottom in spaced relationship.

3. The manhole insert of claim 2 wherein said bottom ribs are radially disposed in said bottom, with one end of said bottom ribs facing said pressure relief valve.

4. The manhole insert of claim 1 further comprising a lift strap attached to said bottom for lifting said manhole insert from the manhole when the manhole cover is removed.

5. The manhole insert of claim 4 wherein both ends of said lift strap are attached to said bottom.

6. The manhole insert of claim 1 wherein said at least one bottom rib further comprises a plurality of bottom ribs provided in said bottom in spaced relationship and further comprising a lift strap attached to said bottom for lifting said manhole insert from the manhole when the manhole cover is removed.

7. The manhole insert of claim 6 wherein said bottom ribs are radially disposed in said bottom, with one end of said bottom ribs facing said pressure relief valve.

8. The manhole insert of claim 7 wherein both ends of said lift strap are attached to said bottom.

9. The manhole insert of claim 1 further comprising seal means provided on said rim for sealing said manhole insert in the manhole.

10. The manhole insert of claim 9 wherein said at least one bottom rib further comprises a plurality of bottom ribs provided in said bottom in spaced relationship.

11. The manhole insert of claim 9 further comprising a lift strap attached to said bottom for lifting said manhole insert from the manhole when the manhole cover is removed.

12. The manhole insert of claim 9 wherein said at least one bottom rib further comprises a plurality of bottom ribs provided in said bottom in spaced relationship and further comprising a lift strap attached to said bottom for lifting said manhole insert from the manhole when the manhole cover is removed.

13. The manhole insert of claim 12 wherein said bottom ribs are radially disposed in said bottom, with one end of said bottom ribs facing said pressure relief valve.

14. The manhole insert of claim 13 wherein both ends of said lift strap are attached to said bottom.

15. The manhole insert of claim 1 further comprising at least one side rib provided in said side wall for strengthening said side wall.

16. The manhole insert of claim 15 wherein said at least one bottom rib further comprises a plurality of bottom ribs provided in said bottom in spaced relationship.

17. The manhole insert of claim 16 wherein said bottom ribs are radially disposed in said bottom, with one end of said bottom ribs facing said pressure relief valve.

18. The manhole insert of claim 17 further comprising a lift strap attached to said bottom for lifting said manhole insert from the manhole when the manhole cover is removed.

19. The manhole insert of claim 18 wherein both ends of said lift strap are attached to said bottom.

20. The manhole insert of claim 16 further comprising seal means provided on said rim for sealing said manhole insert in the manhole.

21. The manhole insert of claim 20 further comprising a lift strap attached to said bottom for lifting said manhole insert from the manhole when the manhole cover is removed.

22. The manhole insert of claim 21 wherein both ends of said lift strap are attached to said bottom.

23. The manhole insert of claim 20 wherein said seal means further comprises a top segment disposed on the top surface of said rim for receiving the manhole cover, a bottom segment disposed on the bottom surface of said rim for seating said rim in the manhole and an end segment spanning the edge of said rim and connecting said top segment and said bottom segment.

24. The manhole insert of claim 23 further comprising at least one opening provided in said rim and wherein said top segment is secured to said bottom segment through said opening.

25. The manhole insert of claim 23 further comprising at least one opening provided in said rim and a plug inserted in said opening and wherein said plug is joined to said bottom segment and said top segment.

26. The manhole insert of claim 24 further comprising at least one seal rib projecting from said bottom segment for engaging the manhole and removably sealing said manhole insert in the manhole.

27. The manhole insert of claim 1 further comprising a vacuum relief valve provided in said bottom for relieving a vacuum in the manhole.

28. The manhole insert of claim 27 wherein said at least one bottom rib further comprises a plurality of bottom ribs provided in said bottom in spaced relationship.

29. The manhole insert of claim 27 further comprising a lift strap attached to said bottom for lifting said manhole insert from the manhole when the manhole cover is removed.

30. The manhole insert of claim 27 further comprising seal means provided on said rim for sealing said manhole insert in the manhole.

31. The manhole insert of claim 27 wherein said at least one bottom rib further comprises a plurality of bottom ribs provided in said bottom in spaced relationship and further comprising:

(a) a lift strap attached to said bottom for lifting said manhole insert from the manhole when the manhole cover is removed;

(b) a top segment disposed on the top surface of said rim for receiving the manhole cover, a bottom segment disposed on the bottom surface of said rim for seating said rim in the manhole, at least one opening provided in said rim wherein said top segment is secured to said bottom segment through said opening and an end segment spanning the edge of said rim and connecting said top segment and said bottom segment; and (c) at least one side rib provided in said side wall for strengthening said side wall.

32. The manhole insert of claim 29 wherein said bottom ribs are radially disposed in said bottom, with one end of said bottom ribs facing said pressure relief valve.

33. The manhole insert of claim 30 wherein both ends of said lift strap are attached to said bottom.

34. A manhole insert for location in a manhole beneath a manhole cover, said manhole insert comprising a dish-shaped body having a curved bottom terminated by an upward-standing, substantially vertically oriented side wall; a plurality of bottom ribs provided in said bottom for strengthening said bottom; a pressure relief valve provided substantially in the center of said bottom for releasing pressure in the manhole; a vacuum relief valve provided in said bottom for relieving a vacuum in the manhole; a rim shaped in the top edge of said side wall for supporting said manhole insert in the manhole; and seal means provided on said rim for sealing said manhole insert in the manhole.

35. The manhole insert of claim 34 wherein said bottom ribs are radially disposed in said bottom, with one end of said bottom ribs facing said pressure relief valve.

36. The manhole insert of claim 35 wherein said seal means further comprises a top segment disposed on the top surface of said rim for receiving the manhole cover, a bottom segment disposed on the bottom surface of said rim for seating said rim in the manhole, an end segment spanning the edge of said rim and connecting said top segment and said bottom segment and at least one opening provided in said rim and a plug inserted in said opening and wherein said plug is joined to said bottom segment and said top segment.

37. The manhole insert of claim 36 further comprising at least one side rib provided in said side wall for strengthening said side wall.

38. The manhole insert of claim 37 further comprising a lift strap having both ends secured to said bottom for lifting said manhole insert from the manhole when the manhole cover is removed.

39. A manhole insert for location in a manhole beneath a manhole cover, said manhole insert comprising a dish-shaped body having a curved bottom terminated by an upward-standing, substantially vertically oriented side wall; a plurality of bottom ribs radially oriented in said bottom and extending from said side wall for strengthening said bottom; a pressure relief valve provided substantially in the center of said bottom for releasing pressure in the manhole; a vacuum relief valve provided in said bottom for relieving a vacuum in the manhole; a rim shaped in the top edge of said side wall for supporting said manhole insert in the manhole; and seal means provided on said rim for sealing said manhole insert in the manhole.

40. The manhole insert of claim 37 wherein said seal means further comprises a top segment disposed on the top surface of said rim for receiving the manhole cover, a bottom segment disposed on the bottom surface of said rim for seating said rim in the manhole, an end segment spanning the edge of said rim and connecting said top segment and said bottom segment, at least one opening provided in said rim and wherein said top segment is secured to said bottom segment through said opening.

41. The manhole insert of claim 40 further comprising:

(a) at least one side rib provided in said side wall for stengthening said side wall; and (b) a lift strap having both ends secured to said bottom for lifting said manhole insert from the manhole when the manhole cover is removed.

* * * * *